US006564701B1

(12) United States Patent
Liu et al.

(10) Patent No.: US 6,564,701 B1
(45) Date of Patent: May 20, 2003

(54) BAND-THICKNESS ADJUSTING DEVICE FOR A PORTABLE PACKING MACHINE

(75) Inventors: Chin-Chang Liu, Taichung (TW); Chi-jan Su, Taipei (TW)

(73) Assignees: Tekpak Corporation, Taichung (TW); Transpak Equipment Corp., Taipei (TW)

( * ) Notice: Subject to any disclaimer, the term of this patent is extended or adjusted under 35 U.S.C. 154(b) by 0 days.

(21) Appl. No.: 10/059,001

(22) Filed: Jan. 30, 2002

(51) Int. Cl.[7] ..... B65B 13/24

(52) U.S. Cl. ..... 100/29; 100/8; 100/33 PB; 53/592; 156/494

(58) Field of Search ..... 100/33 R, 33 PB, 100/29, 32; 53/210, 389, 592, 582; 140/93.2, 93.4, 153, 154; 74/567; 156/494, 502, 580

(56) References Cited

U.S. PATENT DOCUMENTS 4,155,799 A * 5/1979 Matsushita et al. ..... 156/494
4,289,174 A * 9/1981 Massion ..... 140/93.4
4,305,774 A * 12/1981 Wedeking et al. ..... 156/494
4,569,186 A * 2/1986 Mori et al. ..... 53/589
5,181,546 A * 1/1993 Synek ..... 140/93.4
6,047,742 A * 4/2000 Barlasov ..... 140/123.6
6,463,847 B1 * 10/2002 Rauch ..... 100/29

* cited by examiner

*Primary Examiner*—Allen Ostrager
*Assistant Examiner*—Jimmy Nguyen
(74) *Attorney, Agent, or Firm*—Troxell Law Office PLLC

(57) ABSTRACT

A band-thickness adjusting device for a portable packing machine includes an adjusting shaft and an activating rod combined eccentrically with the adjusting shaft, and a press rod pressed axially by eccentric movement of the adjusting shaft to press down a friction head of a fusing device. Then the gap between the friction head and a stationary friction head of the fusing device can be changed to suit to different thickness of packing bands so that pressure against the packing band may be adjusted for the thickness of a packing band, with the gap between the two friction heads freely adjustable.

7 Claims, 9 Drawing Sheets

BAND-THICKNESS ADJUSTING DEVICE FOR A PORTABLE PACKING MACHINE

BACKGROUND OF THE INVENTION

This invention relates to a band-thickness adjusting device for a portable packing machine, particularly to one easy to handle and quick to adjust.

An adjusting device for a conventional portable packing machine shown in FIGS. 1, 2 and 3 includes a crutch rod 11, a handling rod 12, and a stop member 13. The crutch rod and the handling rod have respectively female teeth 111 and male teeth 121 formed in a front center to engage with each other. The crutch rod 11 has a stop plate 112 formed in a front end, and the handling rod 12 has a blocking member 131 to correspond to the stop plate 112, and an eccentric round post 122 formed in a proper portion and pivotally fitted with a press rod 14. When a grip 123 provided at a side of the handling rod 12 is pressed down, the eccentric post 122 rotates for an eccentric distance to press a press rod 14 down for a certain distance so that a friction head 15 located under the bottom end of the press rod 14 is pressed down onto a stationary friction head 16, performing fusing function by friction to a packing band 17 sandwiched between the two friction heads 15 and 16.

When the two friction heads 15 and 16 sandwich the packing band 17, a proper force has to be used so as to avoid too large pressure, or otherwise load on a motor of the adjusting device may be too large to cause irregular operation. In order to apply to packing bands of different thickness, the adjusting device 10 should have the crutch rod 11 provided with the stop plate 112, which has to move in a limited distance to contact a blocking plate 131 of the s top member 13. If the adjusting device 10 is to be adjusted to the thickness of a packing band 17, referring to FIGS. 2 and 3, at first manually hold and pull out a ball-shaped end 113 of the crutch rod 11, disengaging the female teeth 111 from the male teeth 121. Then rotate the crutch rod 11 to a preset angle, and then release it. Then the female teeth 111 automatically move to engage the male teeth 121 by elasticity of a spring 18. Thus alteration of the relative positions of the female and the male teeth 15 and 16 may cause alteration of the moving distance between the stop plate 112 and the blocking plate 131. So when the grip 123 is pressed down, the press rod 14 is pressed down, with the crutch rod 11 also rotated. So when the stop plate 112 contacts the blocking plate 131, the handling rod 12 is also stopped, impossible to move any more, with the friction head 15 pressing on the packing band 17. Thus the adjusting device 10 can change the moving distance of the stop plate 112 to the blocking plate 131 by adjusting the relative positions of the crutch rod 11 and the handling rod 12, controlling the moving-down distance of the pressing rod 14 to suit to different thickness of the packing bands 17.

Although the conventional adjusting device 10 can perform adjusting function to suit to a variety of packing bands having different thickness, its structure is too complicated to result in a high cost. Moreover, the adjusting device 10 is hidden in a machine body 19 as shown in FIG. 3, hardly possible to control an adjusting distance in handling with accuracy and quickness, not ideal in handling. Besides, the smallest distance to be adjusted is limited by every two teeth of the female teeth 111 and the male teeth 121, with the distance impossible to be adjusted freely.

SUMMARY OF THE INVENTION

The purpose of the invention is to offer a band-thickness adjusting device for a portable packing machine, which has an adjusting shaft and an activating shaft pivotally and eccentrically fitted with the adjusting shaft. An eccentric moving distance of the activating rod presses a press rod to move down to change the gap between two friction heads of a fusing device so as to adjust a pressure suitable to different thickness of packing bands. The band-thickness adjusting device has a special simple structure to facilitate handling with quickness.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
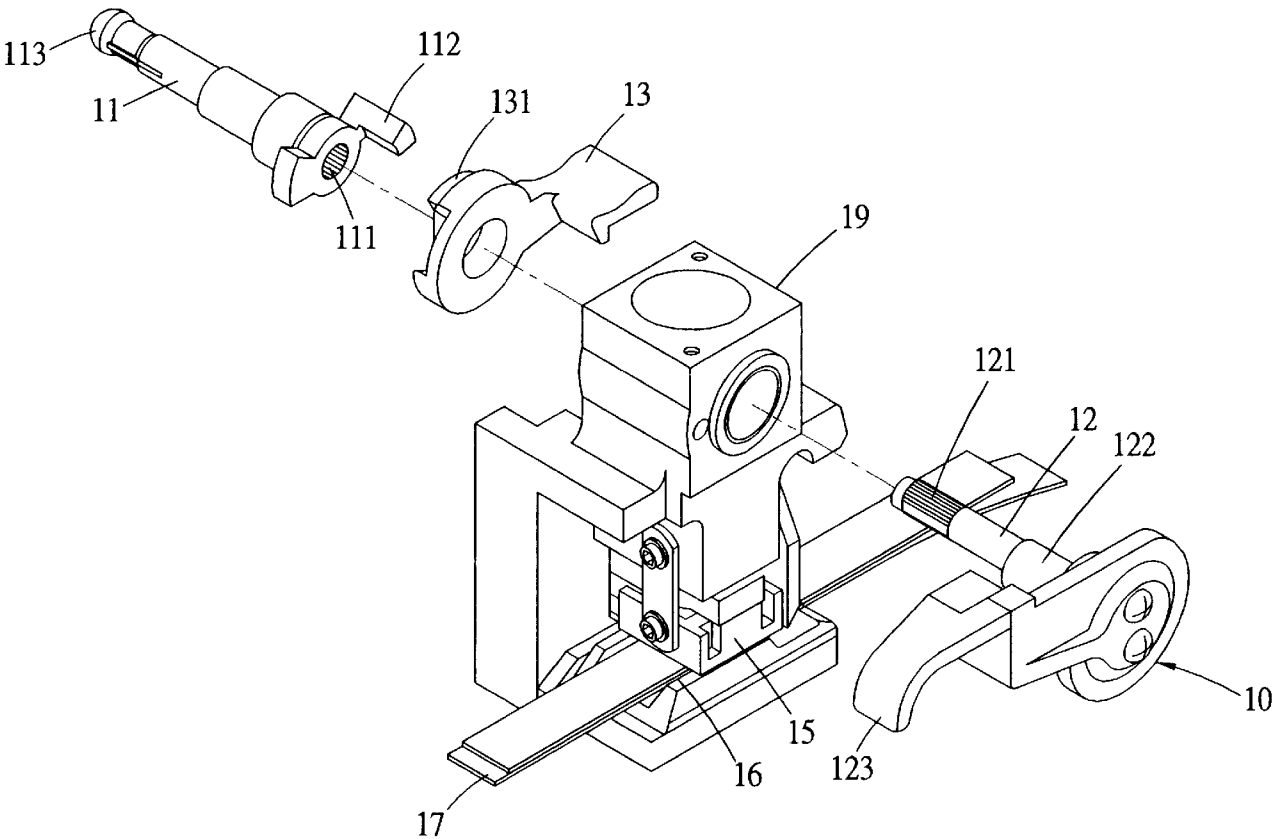
FIG. 1 PRIOR ART
FIG. 1 is an exploded perspective view of an adjusting device for a conventional portable packing machine.
Figure 2:
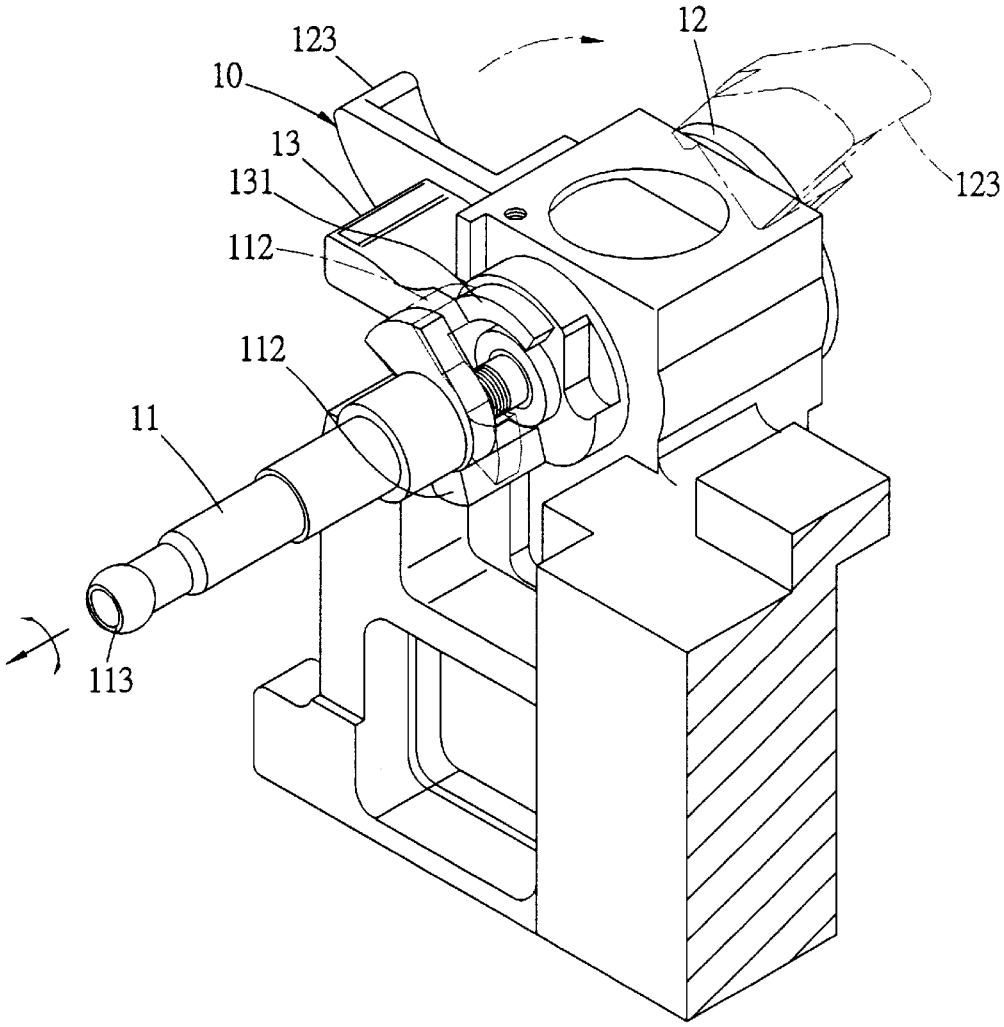
FIG. 2 PRIOR ART
FIG. 2 is a perspective view of the adjusting device for the conventional portable packing machine.
Figure 3:
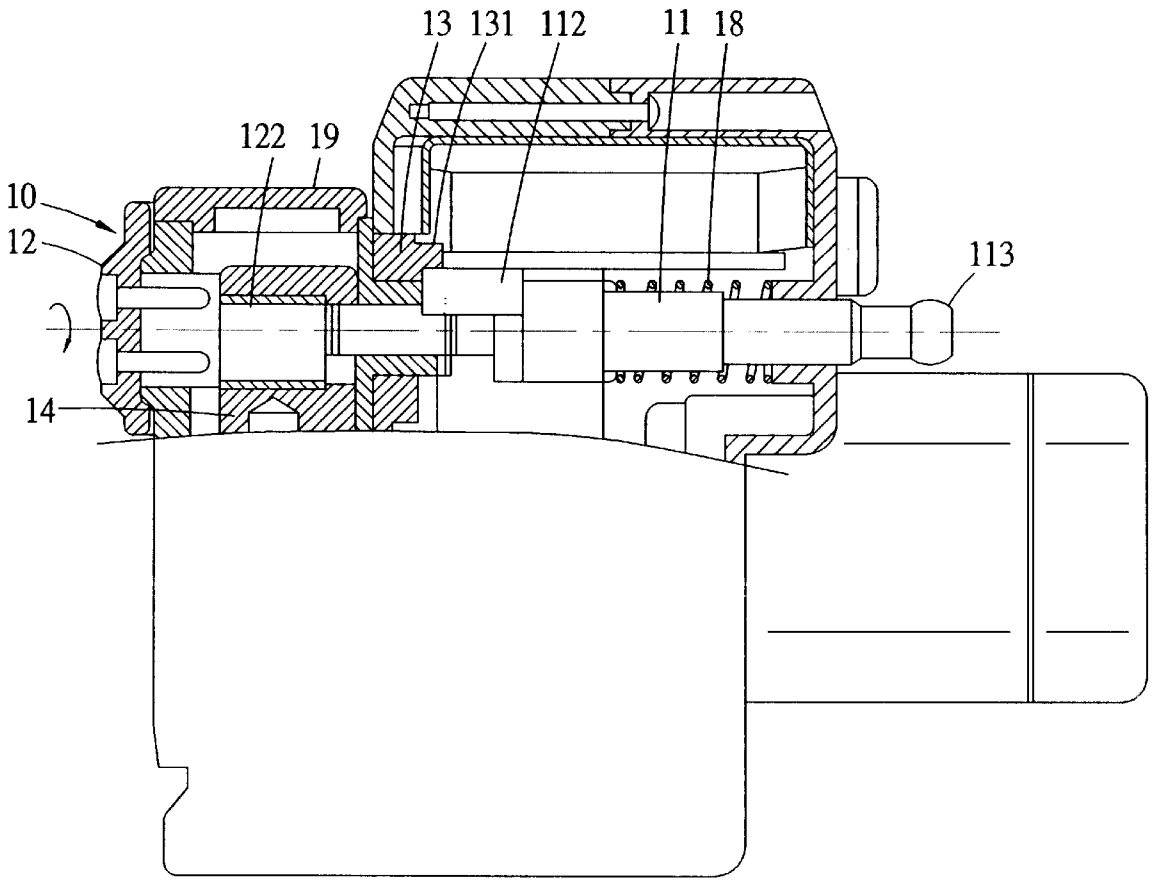
FIG. 3 PRIOR ART
FIG. 3 is a cross-sectional view of the adjusting device for the conventional portable packing machine.
Figure 4:
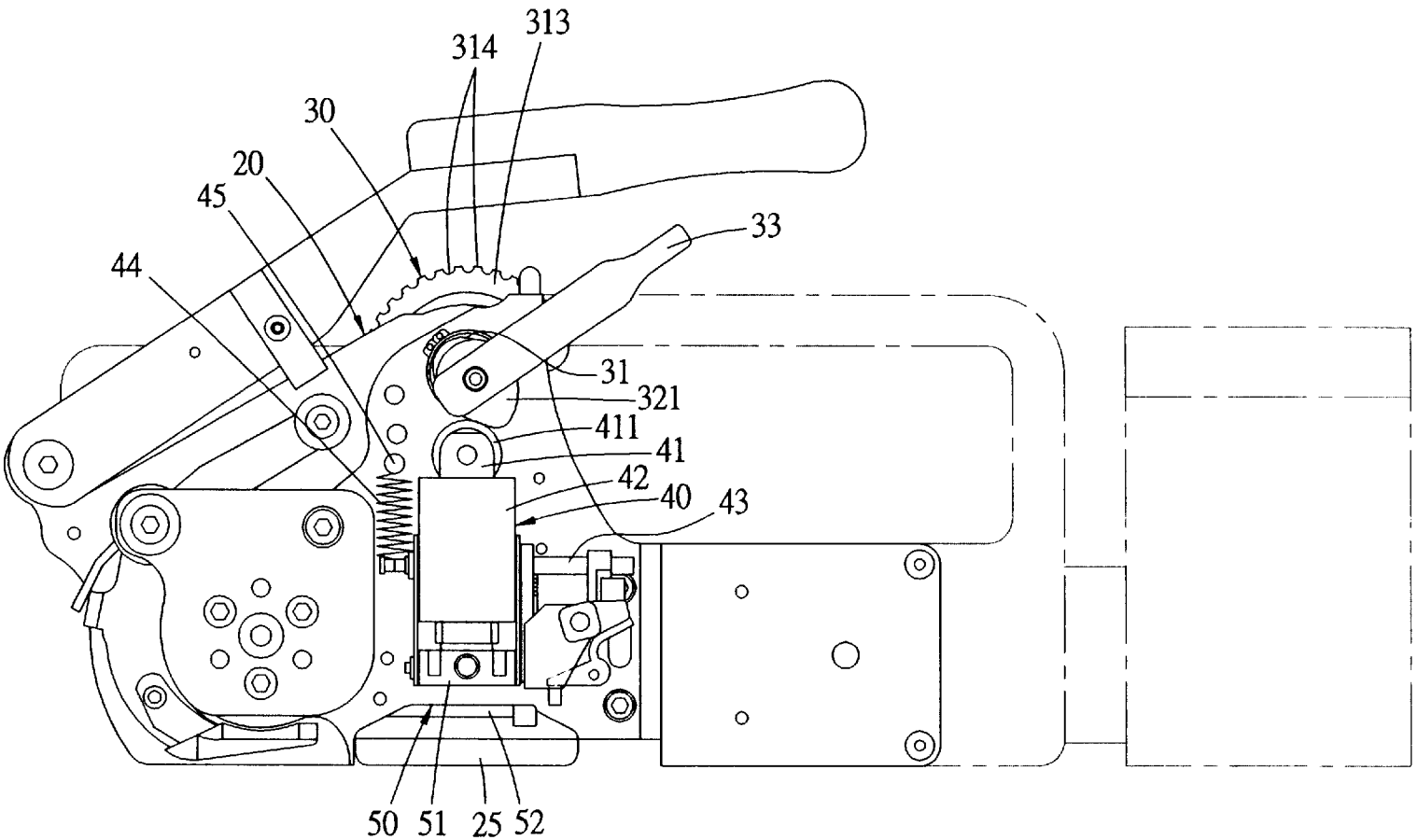
FIG. 4 is a front view of a portable packing machine with a band-thickness adjusting device in the present invention.
Figure 5:
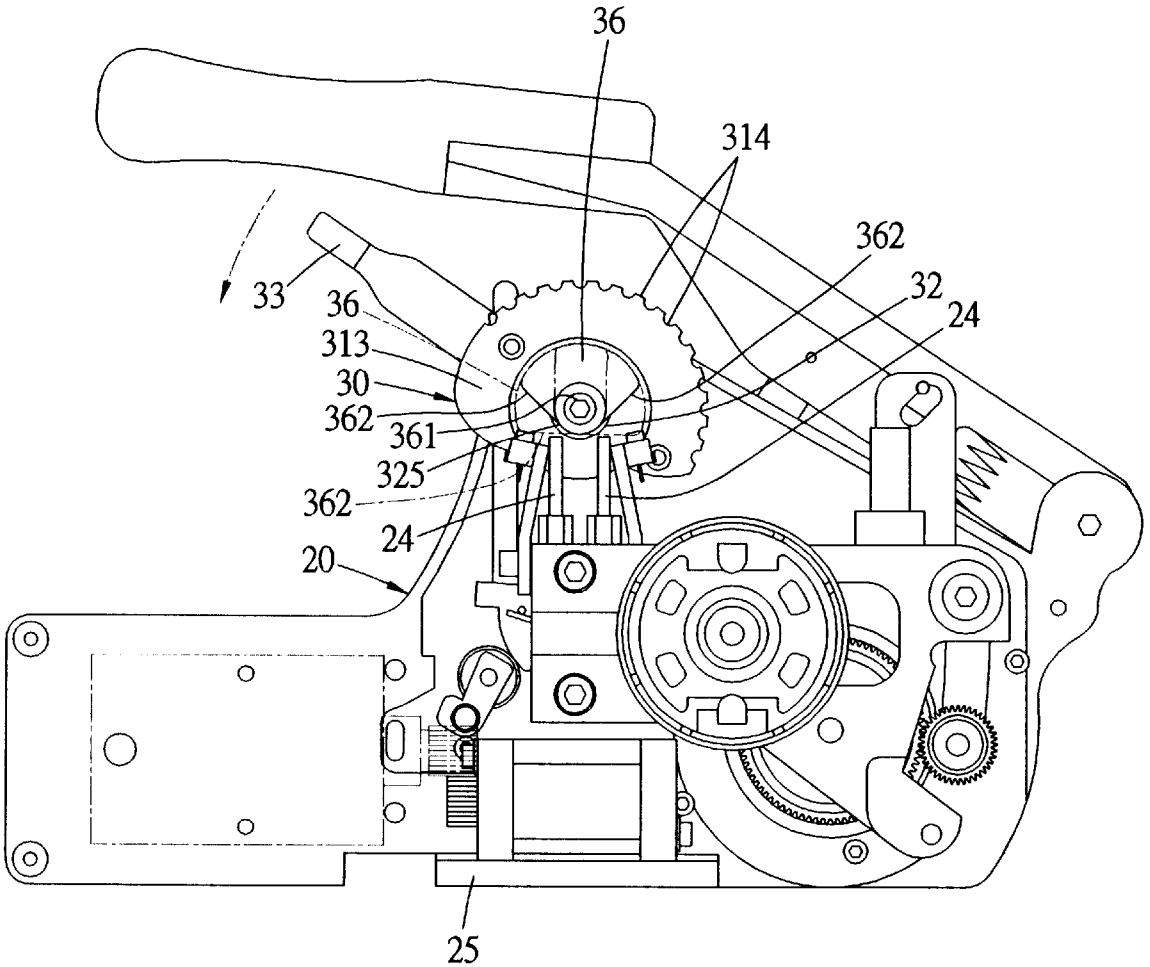
FIG. 5 is a rear view of the portable packing machine with the band-thickness adjusting device in the present invention.
Figure 6:
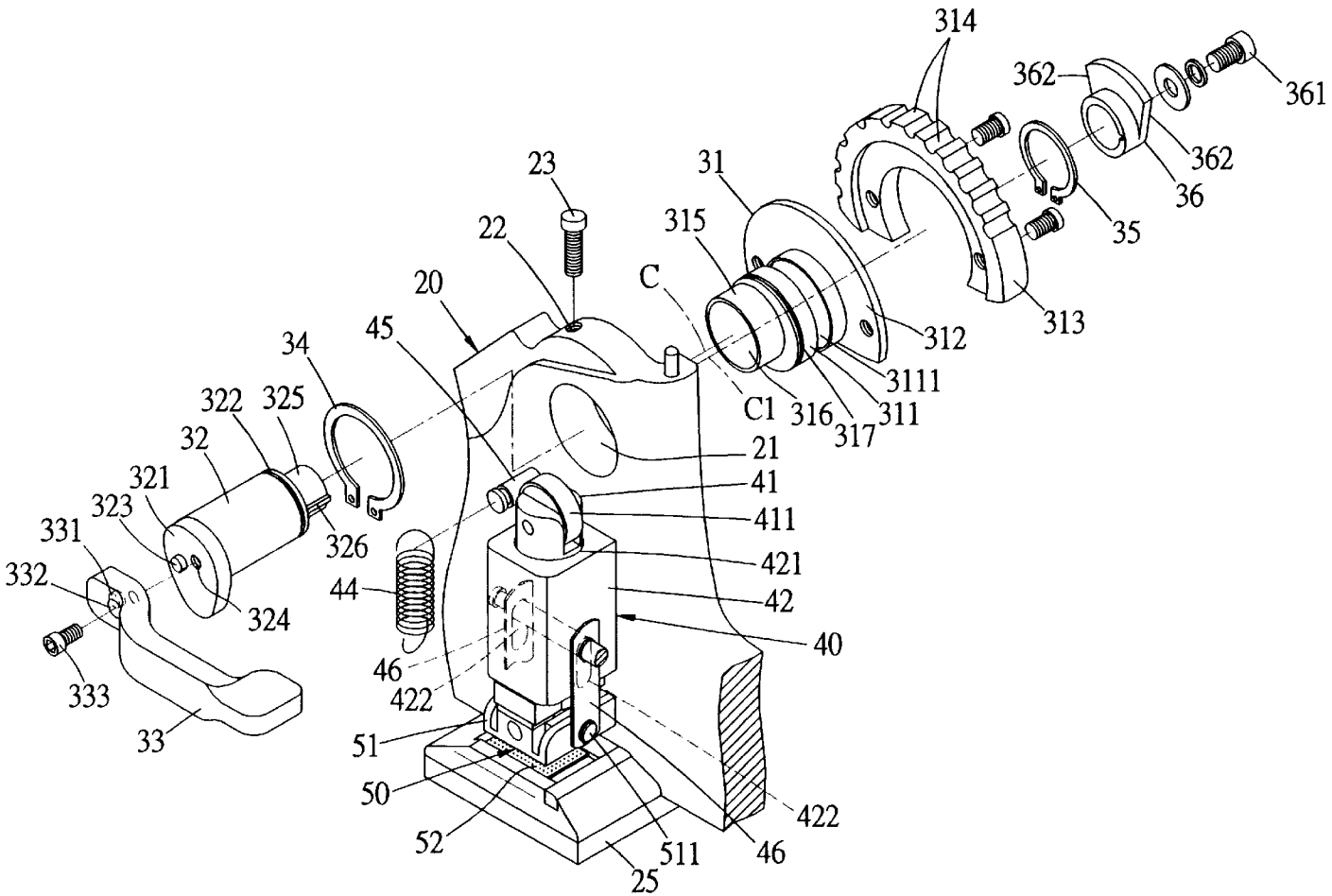
FIG. 6 is an exploded perspective view of the band-thickness adjusting device for a portable packing machine in the present invention.

A preferred embodiment of a band-thickness adjusting device 30 for a portable packing machine in the present invention, as shown in FIGS. 4, 5 and 6, is arranged on a machine body 20, including an adjusting shaft 31, an activating shaft 32, a grip 33, a press device 40 and a fusing device 50 as main components combined together.

The machine body 20 has a shaft hole 21 laterally provided in an upper portion, and a threaded hole 22 provided vertically to communicating with the shaft hole 21 for a screw 23 engage therein.

The adjusting shaft 31 has a pivot shaft 311 formed in an intermediate portion to extend in the shaft hole 21, an annular groove 3111 formed in the pivot shaft 311 to correspond to the threaded hole 22 for a screw 23 to engage therein to secure the adjusting shaft 31 with the machine body 20. The adjusting shaft 31 further has a fan-shaped flange 312 formed at an inner side, a rotating member 313 of a semi annular shape fixed on the flange 312 and having a plurality of teeth 314 formed on an outer surface and protruding above the machine body 20 for easy handling. The adjusting shaft 31 further has an annular extension 315 formed to extend from a front end, and an eccentric pivot hole 316 having an axis parallel to those of the pivot shaft 311 and the shaft hole 21, and pivotally positioned in the shaft hole 21 by means of a C-shaped lock ring 34 engaging around an annular groove 317 located between the pivot shaft 311 and the annular extension 315.

Figure 7:
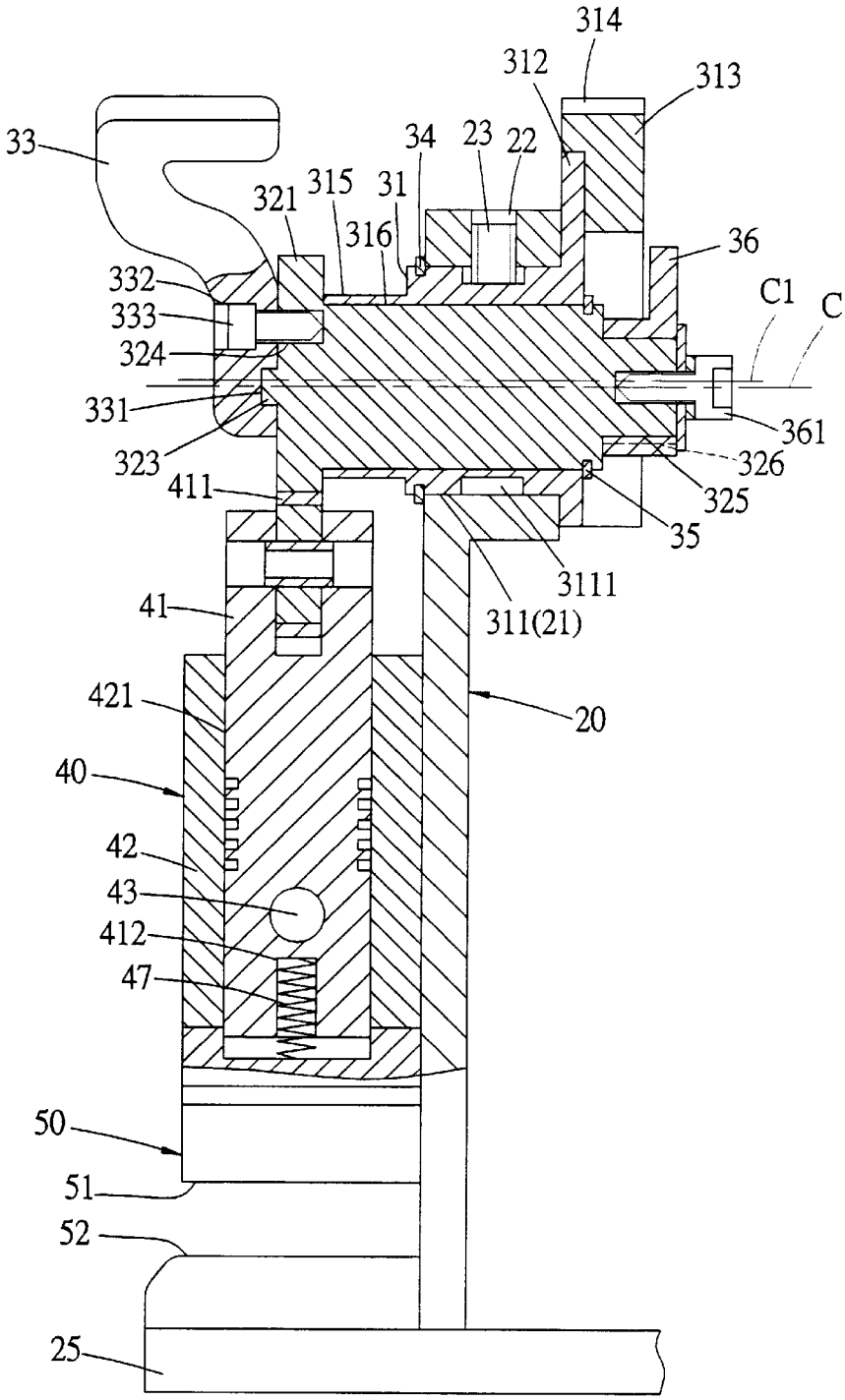
FIG. 7 is a cross-sectional view of the band-thickness adjusting device for a portable packing machine in the present invention.

The activating shaft 32 extends in the eccentric pivot hole 316, having an activating plate 321 of a large circumference and of a cam shape at a front end and always resting on a press rod 41 of the pressing device 40. The activating shaft 32 further has an inner end protruding out of the flange 312, secured in place by a C-shaped lock ring 35 engaging an annular groove 322. Then the activating shaft 32 is pivotally connected to the adjusting shaft 31. The activating plate 321 has a stud 323 and a threaded hole 324 provided in an outer surface, as shown in FIG. 7, the activating shaft 32 has a fit rod 325 provided to extend from an inner end, and the fit rod 325 has a threaded hole 326 in an end surface and a key 327 on an annular surface to fit with a stop plate 36 and secured with a screw 316 screwing in the threaded hole 326. The stop plate 36 is fan-shaped, having two vertical sides 362 to contact a stop rod 24 set on the machine body 20 to restrict a rotating angle of the activating shaft 32.

The grip 33 has a recess 331 and a through hole 332 on an end, the recess 331 faces the stud 323, and the through hole 332 faces the threaded hole 324 for a screw 333 to engage with to secure stably the grip 33 with activating plate 321.

The press device 40 consists of a press rod 41, a shaft base 42, an insert rod 43 and a spring 44. The press rod 41 inserts pivotally in a lengthwise hole 421 of the shaft base 42, and the shaft base 42 is fixed firmly on the machine body 20 under the activating plate 321. A roller 411 is pivotally connected with an upper end of the press rod 41 and contacts the activating plate 321. The insert rod 43 passes laterally through two slide slots 422 provided at two sides of the shaft base 42 and the press rod 41. The spring 44 has one end hooking the insert rod 43 and the other end hooking a bolt 45 fixed on the machine body 20 to elastically push the insert rod 43 to accordingly urge the press rod 41 upward. Further, the bottom of the press rod 41 is connected to the connect rod 511 provided to pass through two connectors 46 at two opposite sides of the insert rod 43 and a friction head 51 of the fusing device 50. Then the friction head 51 is combined with the bottom of the press rod 41 and at the same time, referring to FIG. 7, a buffer spring 47 is positioned in a hole 41 bored in the bottom portion of the press rod 41 and on the top surface of the friction head 51. A stationary friction head 52 of the fusing device is fixed on a bottom plate 25 of the machine body 20, aligned to the friction head 51.

Figure 9:
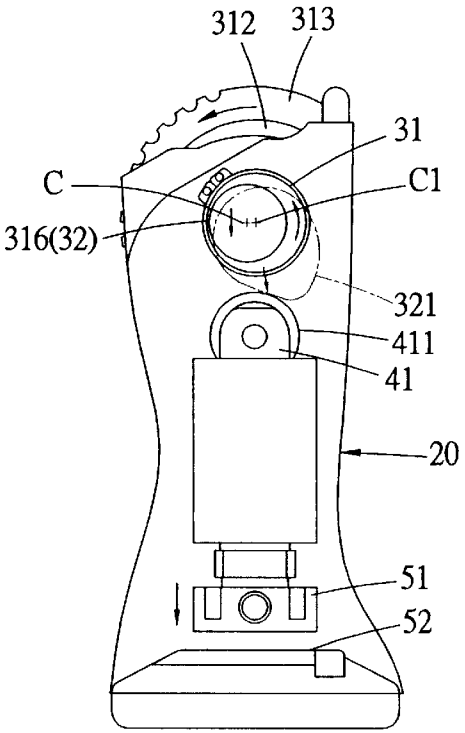
FIG. 9 is a side view of the bank-thickness adjusting device under pressing operation in the present invention; and, FIG. 10 is a side view of the band-thickness adjusting device with a grip pressing down a press rod and then a friction head pressing a packing band in the present invention.
Figure 8:
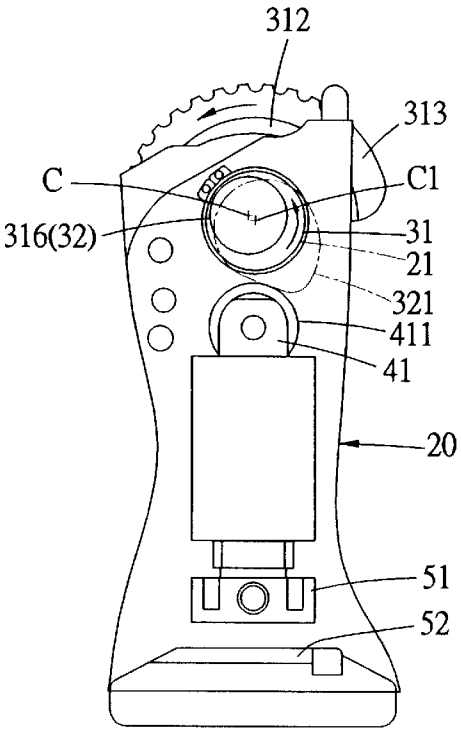
FIG. 8 is a side view of the band-thickness adjusting device under adjusting operation in the present invention.

In handling the band-thickness adjusting device 20, referring to FIGS. 7 and 8, firstly, release the bolt 23 of the machine body 20, freeing the adjusting shaft 31. Then as shown in FIG. 9, a user manually rotates the rotating member 313 to move the flange 312 and the adjusting shaft 31. Then the adjusting shaft 31 rotates in the shaft hole 21, as the axis C1 of the adjusting shaft 31 is the same as that of the shaft hole 21. Then the eccentric pivot hole 316 rotates with an eccentric angle in case of the adjusting shaft 31 rotating, forcing the activating shaft 32 rotate in the same angle so that the activating plate 321 may press down the roller 411 and then the press rod 41. Subsequently, the gap between the friction head 51 and the stationary friction head 52 is changed, obtaining the purpose of adjusting the gap for a packing band 60 to be sandwiched therein. After finishing adjustment, the bolt 23 is screwed tightly against the adjusting shaft 31.

Figure 10:
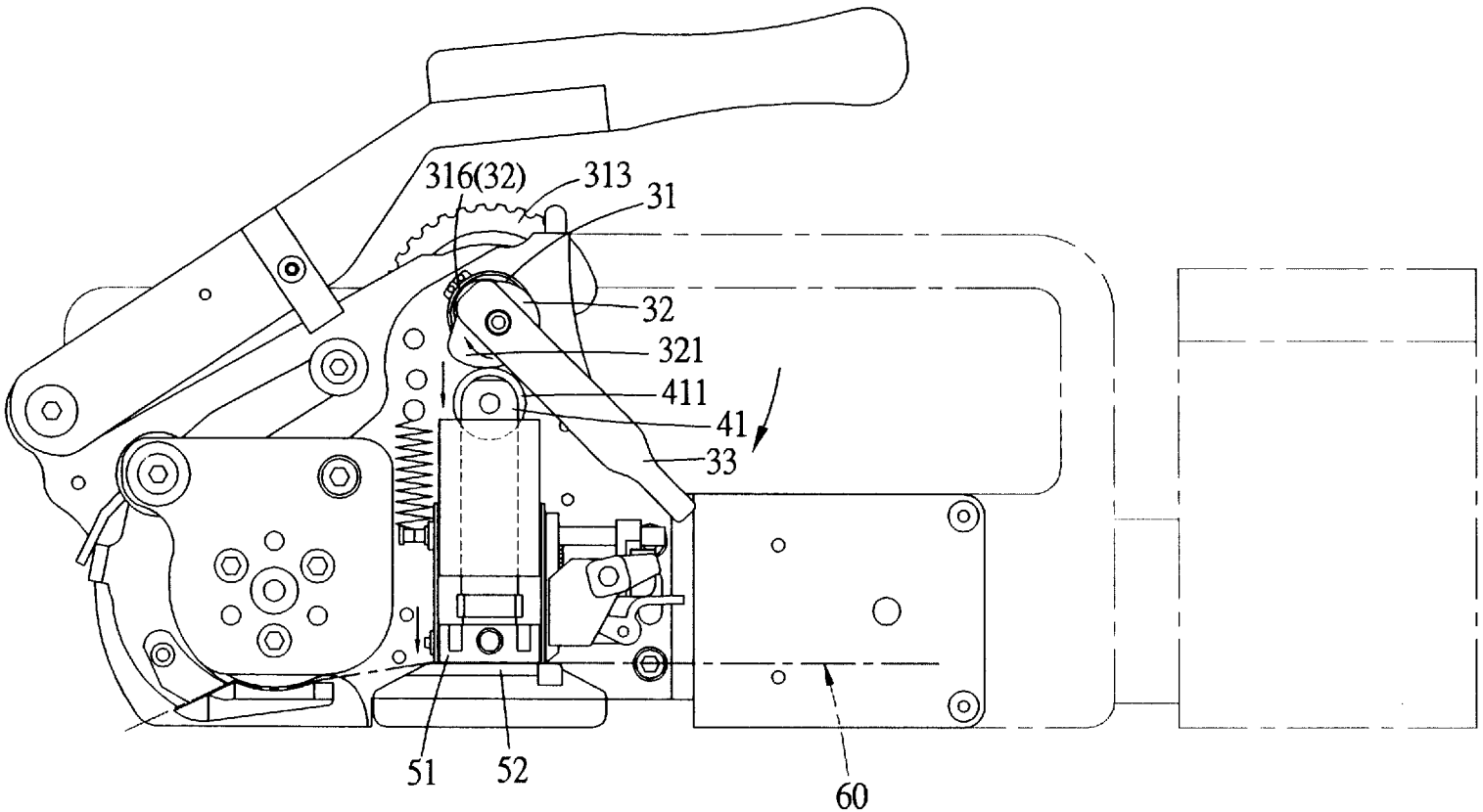

Next, referring to FIG. 10, when the gap between the two friction heads 51 and 52 has been adjusted, the grip 33 may be pressed down for packing to force the activating plate 321 rotate the activating shaft 32 so that the press rod 41 and the friction head 51 may be pressed down, pressing a packing band 60 between the two friction heads 51, and 52. Then, referring to FIG. 5, as the stop plate 36 fitted with the activating shaft 32 rotates at the same time, the stop members 362 of the stop plate 36 are stopped by the stop rod 24, limiting the activating plate 321 in rotation, and touches a switch 26 to start the friction head 51 of the fusing device 50 and fuses the packing band 60.

As described above, the band-thickness adjusting device 30 in the invention can adjust the gap between the two friction heads 51 and 52 to suit to thickness of a packing band 60, mainly utilizing eccentric movement of the adjusting device 30 to change the gap between the two friction heads 51 and 52, and changing a pressing-down distance of the press rod 41. But the distance of pressing-down of the press rod 41 is constant, invariable. Therefore, when the gap between the two friction heads 51 and 52 is adjusted to a small one, pressure of the two heads 51 and 52 sandwiching the packing band 60 is comparatively large. On the contrary, when the gap between the two heads 51 and 52 is adjusted to a large one, pressure against the packing band 60 becomes comparatively small. In other words, when the packing band 60 is thin, the gap between the two heads 51 and 52 is adjusted to a small one, and when the packing band 60 is thick, the gap between the two heads 51 and 52 is to be adjusted to a large one. Thus, the band-thickness adjusting device 30 can be adjusted to use the most proper pressure for various thickness of a packing band 60 sandwiched by the two friction heads 51 and 52, maintaining normal operation of the packing machine.

Lastly, it is worth to mention that rotating action of the adjusting device produces an eccentric moving distance, simple and convenient to handle, but no problem of the distance of every two teeth of the conventional packing machine may arise.

While the preferred embodiment has been described above, it will be recognized and understood that various modifications may be made therein and the appended claims are intended to cover all such modifications that may fall within the spirit and scope of the invention.

We claim:

1. A band-thickness adjusting device for a portable packing machine positioned on a machine body, said band-thickness adjusting device comprising a press rod, and a fusing device having a friction head, said press rod having a bottom connected to said friction head; and, characterized by said band-thickness adjusting device consisting of a adjusting shaft, and an activating shaft, said adjusting shaft having a pivot shaft member formed in an intermediate portion and extending in a shaft hole laterally provided in said machine body, said pivot shaft member having two opposite ends protruding out of two opposite ends of said shaft hole of said machine body, said adjusting shaft having a flange formed at an inner end and an extension formed at an outer end, said extension having a preset length and located at the same side with a pressing device, said adjusting shaft further having a lengthwise eccentric pivot hole, said lengthwise eccentric pivot hole having an axis parallel and eccentric to that of said adjusting shaft, said activating shaft extending in said eccentric pivot hole and having an eccentric activating plate formed at an outer end, said activating shaft always resting on said press rod, and a grip fixed on a proper location of said activating plate.

2. The band-thickness adjusting device for a portable packing machine as claimed in claim 1, wherein a vertical threaded hole is provided in an upper portion of said machine body and communicates with said lateral shaft hole, and a bolt screws in said threaded hole and fixes firmly said adjusting shaft extending in said lateral shaft hole.

3. The band-thickness adjusting device for a portable packing machine as claimed in claim 1, wherein said flange of said adjusting shaft is shaped as a fan, and a semi annular rotating member is fixed on said flange, said semi annular rotating member has a plurality of teeth regularly arranged on an upper surface, and said teeth protruding above said machine body so as to be easily handled.

4. The band-thickness adjusting device for a portable packing machine as claimed in claim 1, wherein said activating plate is shaped as a cam, resting on a top of said press rod, having a stud and a threaded hole in an outer surface, said grip has a recess and a through hole in a side facing said activating plate, said recess and said through hole corresponding to said stud and said threaded hole of said activating plate, a screw engaging said through hole and then said threaded hole to secure said grip with said activating plate.

5. The band-thickness adjusting device for a portable packing machine as claimed in claim 1, wherein said activating shaft has a fitting rod provided to extend from an inner side, said fitting rod having a threaded hole in an end surface and a key on an annular surface, a stop plate provided to fit with said fitting rod, a screw screwing through said stop plate and engaging said threaded hole of said fitting rod to secure said stop plate with said activating rod, said stop plate shaped as a fan and having two vertical stop sides to face a stop rod provided on said machine body for limiting a rotating angle of said activating shaft.

6. The band-thickness adjusting device for portable packing machine as claimed in claim 1, wherein said press device consists of said press rod, a shaft base, a fitting rod and a spring, said press rod pivotally fitting in a lengthwise hole of said shaft base, said shaft base fixed firmly on said machine body under said activating plate, a roller pivotally connected to an upper end of said press rod, said roller contacting an upper end of said activating plate, said fitting rod laterally extending through two slots provided in two sides of said shaft base and said press rod, said spring having one end hooking said fitting rod and the other end hooking a bolt fixed on said machine body, said spring elastically pushing upward said fitting rod and then said press rod, said press rod having its bottom connected to a connect rod passing through two connectors located at two sides of said fitting rod and a friction head of said fusing device so as to combine said friction head with said bottom of said press rod, a buffer member provided at connecting point of said bottom of said press rod and an upper surface of said friction head, a stationary friction head fixed on a bottom plate of said machine and aligned to said friction head.

7. The band-thickness adjusting device for a portable packing machine as claimed in claim 1, wherein said press rod has two holes formed in its bottom portion for said two buffer members to fit therein, said buffer members being compress springs.

* * * * *